United States Patent [19]

Dozer

[11] Patent Number: 4,603,638

[45] **Date of Patent: * Aug. 5, 1986**

[54] TRAIN SYSTEM WITH VARIABLY TILTING RAIL

[75] Inventor: Charles S. Dozer, Carlsbad, Calif.

[73] Assignee: Charles S. Dozer Enterprises, Inc., Carlsbad, Calif.

[ * ] Notice: The portion of the term of this patent subsequent to Jan. 1, 2002 has been disclaimed.

[21] Appl. No.: 682,534

[22] Filed: Dec. 17, 1984

Related U.S. Application Data

[63] Continuation of Ser. No. 404,819, Aug. 3, 1982, Pat. No. 4,491,073.

[51] Int. Cl.[4] ..... B61B 3/02

[52] U.S. Cl. ..... 104/95; 104/76; 104/120; 105/145; 105/154

[58] Field of Search ..... 104/74, 76, 89, 93, 104/95, 118-120; 105/141, 144, 145, 149-154, 156

[56] References Cited

U.S. PATENT DOCUMENTS

| | | | |
|---|---|---|---|
| 489,330 | 1/1893 | Rutter | 105/156 X |
| 2,009,904 | 7/1935 | Purues | 104/77 X |
| 3,319,581 | 5/1967 | Churchman et al. | 105/141 |
| 3,525,306 | 8/1970 | Edel | 105/149 X |
| 3,610,160 | 10/1971 | Alimanestianu | 104/76 X |
| 3,677,188 | 7/1972 | Bordes | 104/120 |
| 4,491,073 | 1/1985 | Dozer | 104/95 |

*Primary Examiner*—Randolph A. Reese
*Assistant Examiner*—Glenn B. Foster
*Attorney, Agent, or Firm*—William W. Haefliger

[57] ABSTRACT

A train system includes (a) a train car, (b) a support for the car adapted to be guided along a rail having variable angular tilt along its length and relative to horizontal, whereby the support assumes the tilt of the rail, and (c) a gimbal coupled between the car and support to accommodate rotation of the support relative to the car as the car travels lengthwise of and along the rail, whereby the car remains upright despite variable tilting of the rail along which the car travels.

14 Claims, 10 Drawing Figures

TRAIN SYSTEM WITH VARIABLY TILTING RAIL

This is a continuation of application Ser. No. 404,819, filed Aug. 3, 1982, now U.S. Pat. No. 4,491,073, issued Jan. 1, 1985.

BACKGROUND OF THE INVENTION

This invention relates generally to train systems, and more particularly concerns a train that is guided by and can move along a rail having a variable angle of inclination relative to horizontal, along its length, and which because of its mode of support maintains the train car or cars in upright condition. The invention is applicable to full size trains for transporting people, goods, etc., and is also applicable to toy train systems.

One of the critical problems as respects train systems is the lack of available right-of-way, or the excessive cost of same. Such right-of-way for track has become increasingly expensive, and indeed prohibitively so, and in many cases simply unavailable. Accordingly, there is need for train designs that can accommodate to narrow and/or unusual right-of-way as for example above city streets, and without requiring installation of massive track or rail support systems.

SUMMARY OF THE INVENTION

It is a major object of the invention to provide a simple and compact train system meeting the above need, the concepts and apparatus of the invention also being applicable to toys. Basically, the system comprises:

(a) a train car, (b) a support for the car adapted to be guided along a rail having variable angular tilt along its length and relative to horizontal, whereby the support assumes the tilt of the rail, and (c) a gimbal coupled between the car and support to accommodate rotation of the car relative to the support as the car travels lengthwise of and along the rail, whereby the car remains upright despite variable tilting of the rail along which the car travels.

As will appear, the gimbal may typically include at least one, and preferably two or three gimbal ring assemblies, spaced lengthwise of each car, and extending about the car so that the ring or rings define an axis extending in alignment with the car; and each assembly typically includes a guide unit attached to the rail engaging support, and a second unit rotatable with the car and relative to the guide unit.

It is a further object of the invention to provide a drive system that includes a tilt sensor as well as a drive motor and gearing coupled with the rotatable ring, controlling the operation of the motor, both forwardly and reversely. Further, the rail on which the support slides typically twists along its length, and about its lengthwise axis, to accommodate to available right-of-way, which may or may not include ground surfaces, i.e. the rail may be laid against buildings, or supported in inverted condition, as will be seen.

These and other objects and advantages of the invention, as well as the details of an illustrative embodiment, will be more fully understood from the following specification and drawings, in which:

DRAWING DESCRIPTION

Figure 9:
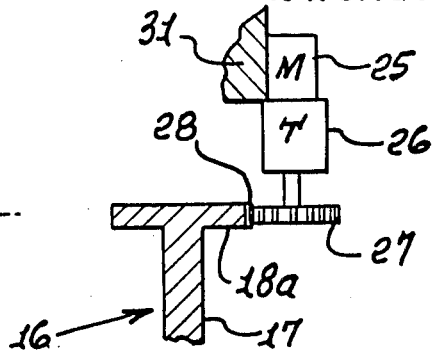
Figure 7A:
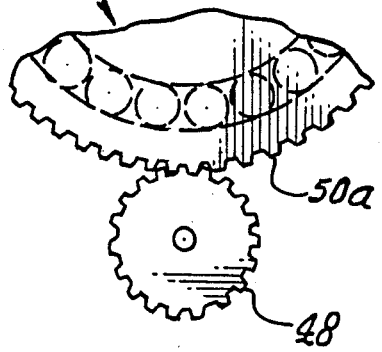
FIG. 7 is a fragmentary section showing a car rotating drive.
Figure 7:
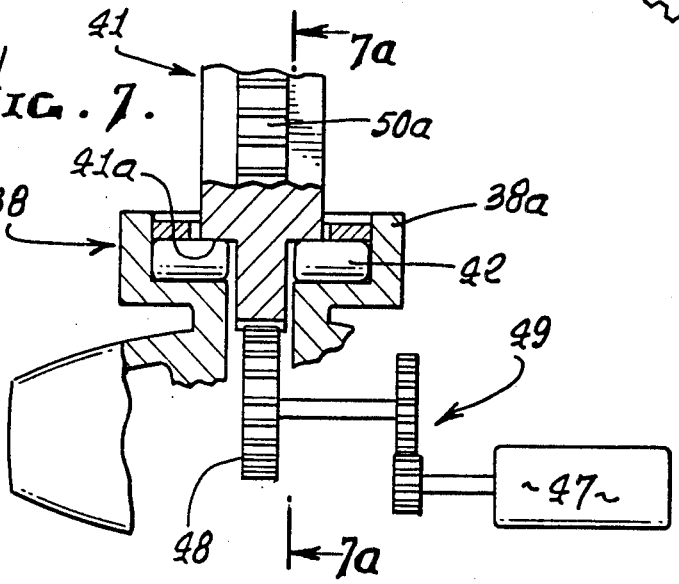
Figure 8:
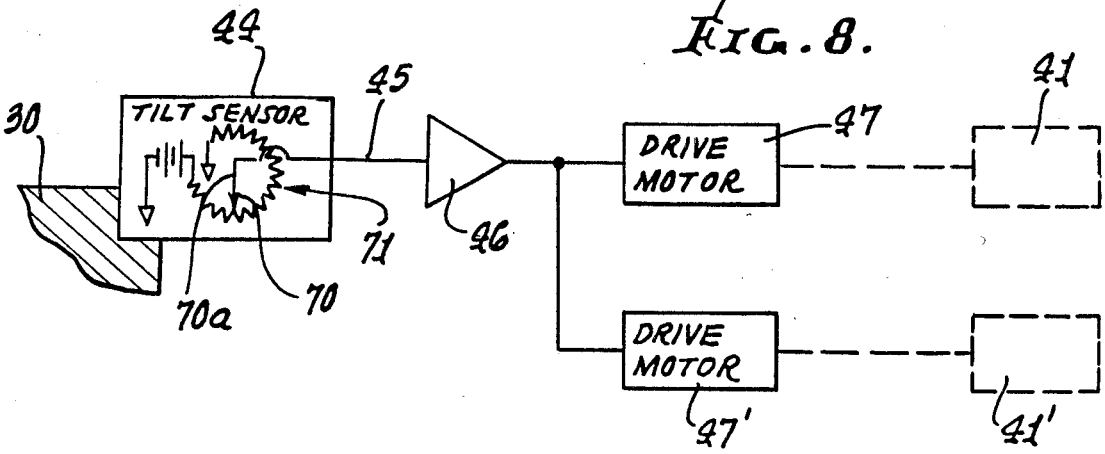

FIG. *7a* is a section on lines *7a—7a* of FIG. 7;

FIG. 8 is a block diagram showing drive motor response to sensing of train support rotation; and FIG. 9 is a fragmentary section showing one method of propelling the train along the rail.

DETAILED DESCRIPTION

In the drawings, the train system 10 includes cars 11 having bodies 12 of desired design with windows indicated at 13, of desired design and location. Within the cars there may be seats 14 and aisle way 15, as shown in FIG. 2, it being an objective of the invention that the cars remain upright during train travel, despite rotation or tilting of the rail or track 16 along which the train travels. See in this regard the cars 11 in FIGS. 4–6 which remains upright despite 180° tilting, i.e. inverting of the rail in FIG. 4; 90° tilt of the rail in FIG. 5, and 45° tilt of the rail in FIG. 6. The train may include a vertical member 17 (in FIG. 1) and a cross-piece 18 defining flanges 18*a* which retain the car support 30 to the rail. Thus, the rail may have a T-shaped cross section, as shown.

Figure 3:
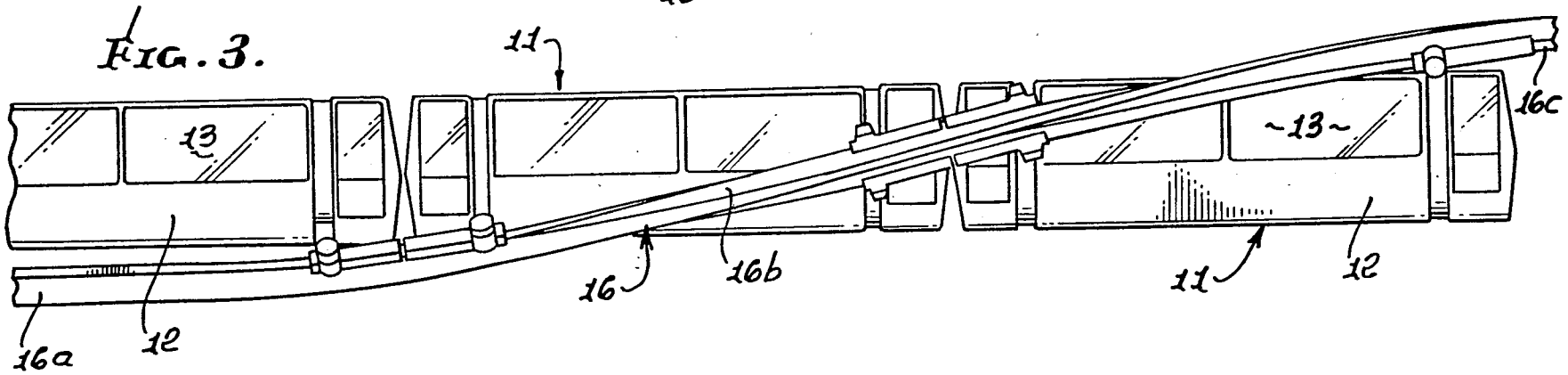
FIG. 3 is a side elevation showing a track or rail turning through 180°, lengthwise, and also showing a train with cars remaining upright.
Figure 5:
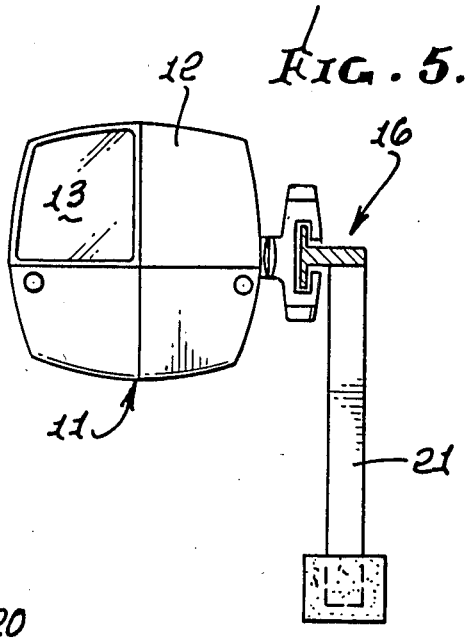
FIG. 5 is an end view showing a track or rail rotated 90°, with the train suspended.
Figure 4:
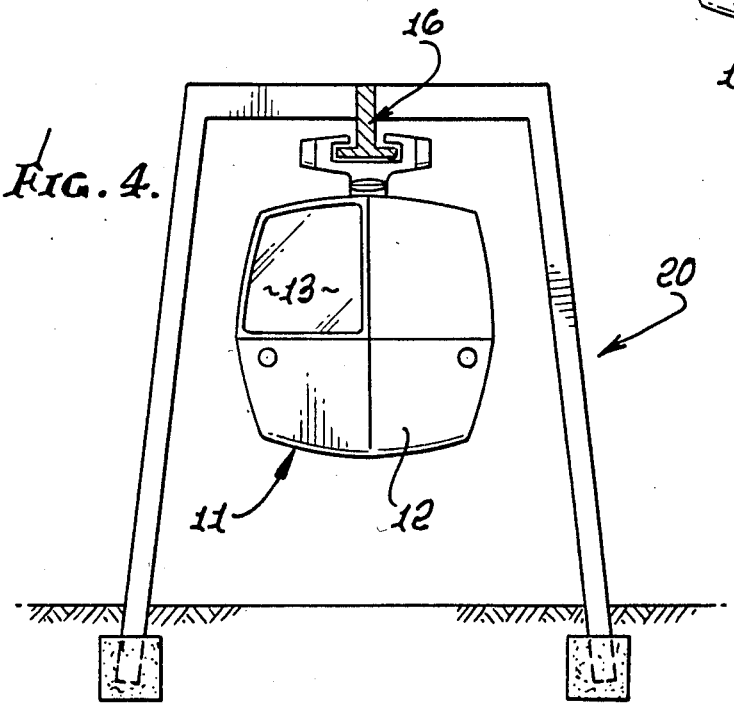
FIG. 4 is an end view showing an inverted track or rail, and the train suspended.
Figure 6:
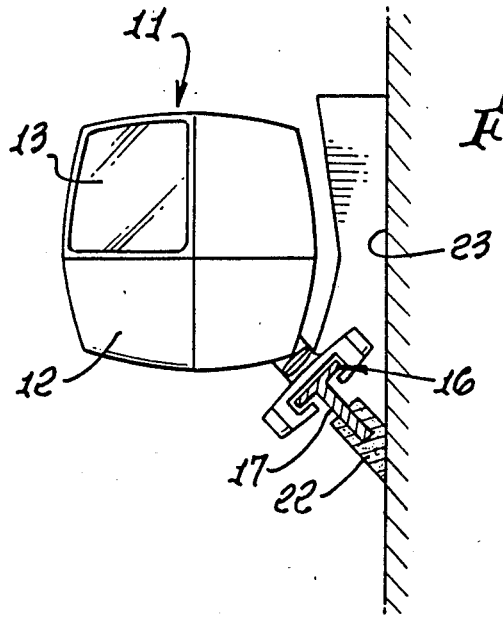
FIG. 6 is an end view showing a track or rail rotated 45°, with the train suspended.

A stansion 20 for the inverted and elevated rail 16 is shown in FIG. 4, whereas an upright or post 21 supports the tilted rail in FIG. 5. In FIG. 6 the 45° tilted post 22 for the rail may project from the side 23 of a building or other structure, showing that the rail may be run along or over a city street, while positioned adjacent buildings at the side of the street. FIG. 3 shows the rail 16 upright at 16*a*, gradually tilting at 16*b*, and gradually tilting at 16*b*, and inverted at 16*c*, with the train nevertheless running along the rail. Any suitable drive system or means may be provided to produce forward or reverse drive for the train, as for example the reversible drive motor 25, in FIG. 9, which is operatively connected via speed reducing transmission 26 with a gear 27. The latter meshes with cogs 28 at the side of one of the rail flanges 18*a*. Other reversible drives may be employed, as for example a linear induction motor.

The motor 25 and transmission 26 may be carried by a support for the car indicated at 31. In FIG. 2 the support 30 is shown as having C-shape, with laterally extending arms 31 provided with recesses or slots 29 closely receiving the rail flanges 18*a*. Low friction "slipper" pads 32–34 may be carried by the arms 31 to engage opposed surfaces of the rail, as shown, whereby the support is guided to smoothly run along the rail while clinging thereto, during train travel. Alternatively, roller bearings may be provided at the pad locations to engage the rail and thereby locate or center the support 30 relative to the rail and transfer loading thereto with minimum friction. The supports may be extended lengthwise at 29*a* to carry magnetic couplings indicated at 36 in FIG. 1, to intercouple successive cars, allowing car pivoting.

In accordance with an important aspect of the invention, a gimbal is coupled between the car 11 and its support 30 to accommodate rotation of the support relative to the car, as the car travels lengthwise of and along the rail, whereby the car remains upright despite tilting of the rail along which the car and support travel. Referring to FIGS. 1, 2, 7 and 7*a*, the gimbal 37 includes at least one gimbal unit such as yoke 38 having an axis 39 in alignment with the car; accordingly, the gimbal yoke 38 which is integral with support 30, extends partially about the car and its interior 40. The gimbal also includes a ring 41 rotatably carried by yoke 38, the ring 41 attached to the car or its frame and rotatably guided by yoke 38. See for example roller bearings 42 between arms 38*a* of ring 38, and surfaces 41*a* of ring 41, in FIG. 7. As the track and yoke 38 variably tilt, the car center of gravity, below axis 39, acts to maintain the car upright, the ring 41 being adapted to rotate in the yoke.

Alternatively, and as shown in FIG. 7, a drive system may be coupled to the car to effect its controlled rotation in response to progressively changing tilt of the rail, to maintain the car upright. Extending the description to FIG. 8, a tilt sensor 44, such as an accelerometer, is carried by support 30 to sense the extent of lateral tilting of the support and yoke relative to horizontal as they travel along the rail. The degree of "tilt" output 45 of the sensor is amplified at 46 and the amplifier drives the drive motor 47, also shown in FIG. 7. See in this regard pendulum 70 on the wiper 70*a* of potentiometer 71. If the accelerometer on the support tilts clockwise, the motor is energized to rotate the car counterclockwise to maintain it upright, and vice versa. Feedback control may also be employed.

The motor drives a spur gear 48, via a speed-reducing transmission 49, and gear 48 drives a ring gear 50*a* on the periphery of ring 41. Other drives may be substituted for the one illustrated. Note that ring gear 50*a* projects annularly outwardly between arms 38*a* of yoke 38, to engage spur gear 48. The arrangement is such that a vertical plane 54 through axis 39 bisects the car 11 and support 30, as viewed in FIG. 2, and also passes through the rail, such as rail member 17. Rings 38 and 41 are coaxial about axis 39.

Figure 1:
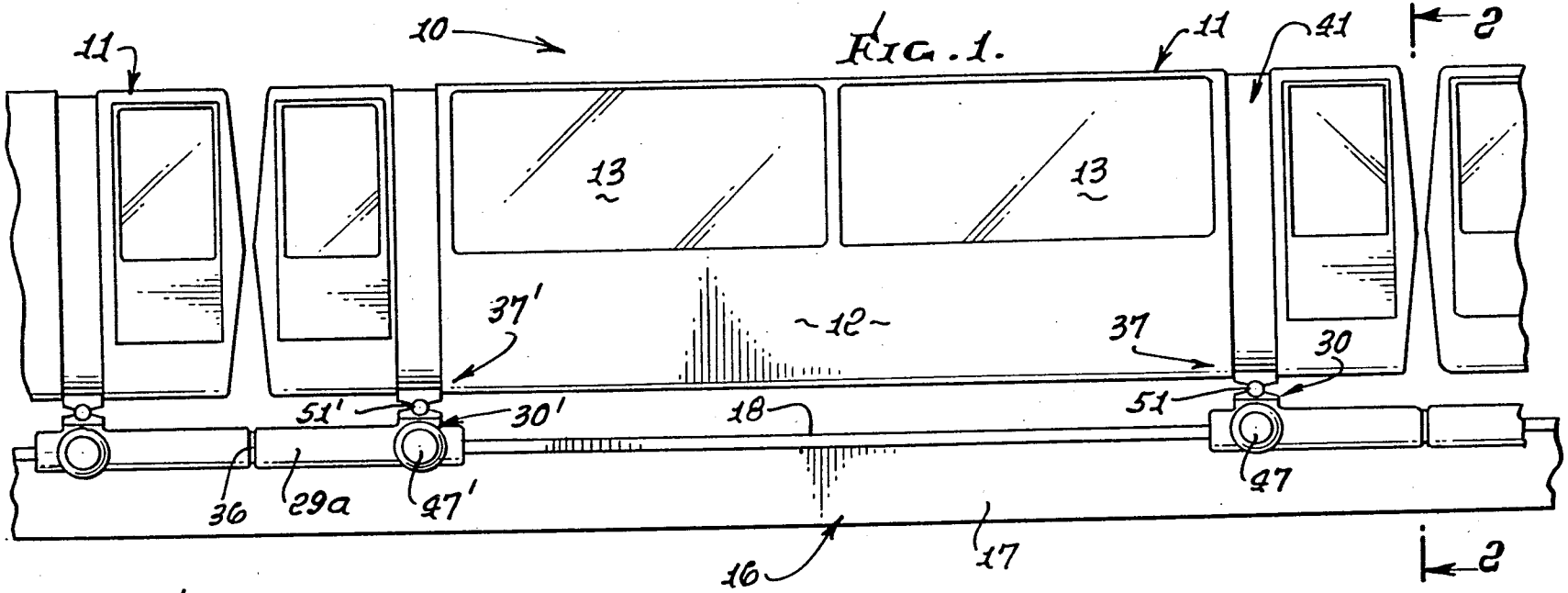
FIG. 1 is a side elevation showing a train incorporating the invention.
Figure 2:
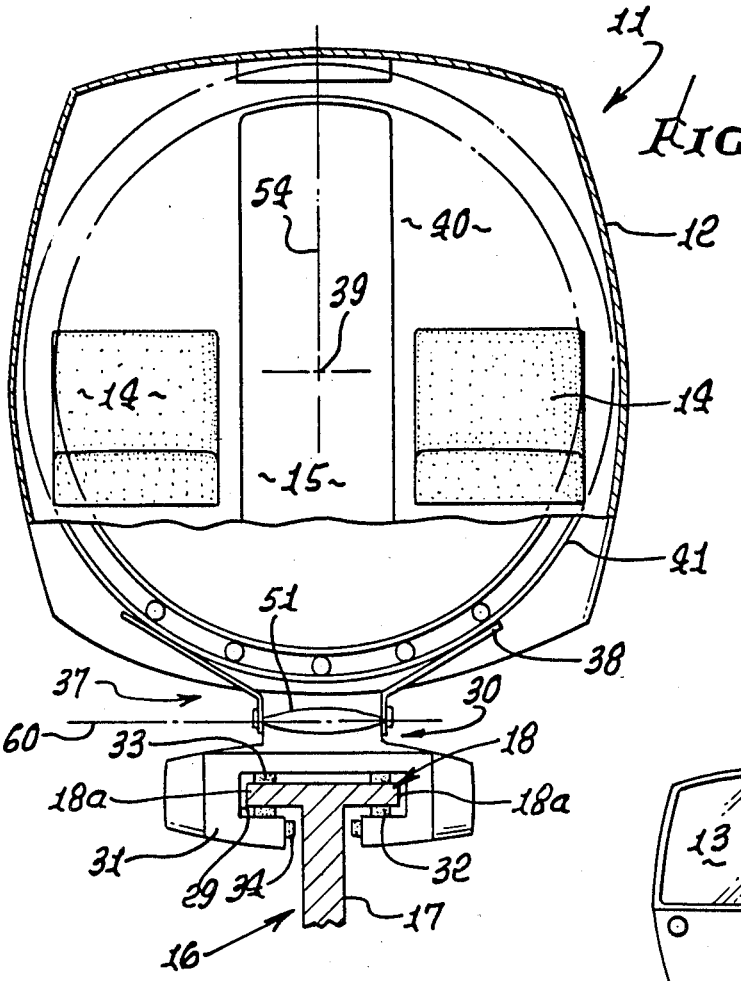
FIG. 2 is an end view taken on lines 2—2 of FIG. 1.

FIG. 1 also shows a second gimbal 37', like gimbal 37 located near the opposite end of the car, such that two like gimbals are provided for each car, near opposite ends thereof. FIG. 8 shows the second motor 47' associated with gimbal 37', and driving ring 41' thereof to the same extent ring 41 is driven by motor 47. A third or multiple gimbals may be employed, in like manner.

Finally, hinges or wrist pins may be provided as at 51 and 51' and associated with the supports 30 and 30' to allow the car to pitch relative to the supports, to limited extent, during travel along a rail, which may be slightly curved in a "crown" or "reverse crown" sense. The hinges have axes which extend transversely as at 60 (in FIG. 2) relative to the rail. Note in FIG. 3 that the rail twists along its length and about a length axis thereof.

Tilt control may be adjusted for car travel along curved extents of the rail.

I claim:

1. In a train system, the combination that comprises (a) a train car, (b) a support for the car adapted to be guided along a rail having variable angular tilt along its length and relative to horizontal, whereby the support assumes the tilt of the rail, (c) a gimbal coupled between the car and support to accomodate rotation of the support relative to the car as the car travels lengthwise of and along the rail, whereby the car remains upright despite variable tilting of the rail along which the car travels, (d) the gimbal including at least one gimbal unit having an axis in alignment with the car, the gimbal also including a ring rotatably carried by a yoke, the ring attached to the car and rotatably guided by the yoke which is carried by the support, (e) a drive system operatively coupled to the ring to effect rotation thereof in response to progressively changing tilt of the support as the car travels along the rail, and (f) including said rail on which the support is carried, said rail having a cross section that twists and becomes substantially inverted along its length about a length axis defined by the rail, (g) and including a hinge associated with the support and located between said rail and said gimbal unit axis to accomodate pivoting of the car about only a single transverse hinge axis relative to the rail, (h) the hinge carrying the yoke, and said single axis of pivoting extending parallel to a plane defined by said ring portion, the gimbal ring, yoke, and hinge axis extending in a common plane.

2. The combination of claim 1 including a drive system coupled to the car to effect said rotation of the car in response to progressively increasing or decreasing tilt of the support as the car travels along the rail.

3. The combination of claim 1 wherein said cross section has a side surface or surfaces that twists or twist along said length axis defined by the rail and which is engaged by the support.

4. The combination of claim 1 wherein said gimbal ring extends about the car, a vertical plane through the ring axis bisecting the car and said support.

5. The combination of claim 1 wherein said support slidably extends about and along said cross section.

6. The combination of claim 1 including supports for the twisted rail adapted to support same from sidewardly offset structure or to support the rail in partially or fully inverted condition.

7. The combination of claim 1 wherein said unit extends about a length axis of the car.

8. The combination of claim 1 wherein the gimbal includes two gimbal rings that define a common longitudinal axis in alignment with the car, the two rings spaced apart longitudinally, lengthwise of the car.

9. The combination of claim 2 wherein said drive system includes a drive motor, and gearing including a ring gear associated with the car and coupled between the motor and the car.

10. The combination of claim 9 including a tilt sensor operatively carried by the support and coupled in controlling relation with the drive motor.

11. The combination of claim 1 wherein the car and ring are free to rotate relative to the yoke, the car having a center of gravity below the level of the axis of car rotation.

12. The combination of claim 1 wherein the car and ring are free to rotate relative to the yoke, the car having a center of gravity below the level of the axis of car rotation.

13. In a train system, the combination that comprises (a) a train car, and rail means, (b) a support for the car guided along the rail means which has variable angular tilt along its length and relative to horizontal, whereby the support assumes the tilt of the rail, (c) a gimbal coupled between the car and support to accomodate rotation of the support relative to the car as the car travels lengthwise of and along the rail, whereby the car remains upright despite variable tilting of the rail along which the car travels, (d) said rail having a cross section that twists and becomes substantially inverted along its length about a length axis defined by the rail, (e) and including a hinge associated with the support and located between said rail and a gimbal unit axis in alignment with the car to accomodate pivoting to the car about only a single transverse hinge axis relative to the rail, (f) the gimbal including a yoke and a ring portion carried by the yoke and rotatably guided thereby, the hinge carrying the yoke and said single axis of pivoting extending parallel to a plane define by said ring portion, the gimbal ring, yoke and hinge axis extending in a common plane.

14. In a train system, the combination that comprises (a) a train car, (b) support for the car adapted to be guided along a rail having variable angular tilt along its length and relative to horizontal, whereby the support assumes the tilt of the rail, and (c) a gimbal coupled between the car and support to accomodate rotation of the support relative to the car as the car travels lengthwise of and along the rail, whereby the car remains upright despite variable tilting of the rail along which the car travels, (d) said rail having a cross section that twists and becomes substantially inverted along its length about a length axis defined by the rail, (e) and including a hinge associated with the support and located between said rail and a gimbal axis in alignment with the car to accomodate pivoting of the car about only a single transverse hinge axis relative to the rail, (f) the gimbal including a yoke and a ring portion carried by the yoke and rotatably guided thereby, the hinge carrying the yoke and said single axis of pivoting extending parallel to a plane defined by said ring portion, the gimbal ring, yoke, and hinge axis extending in a common plane.

* * * * *